US006786742B2

(12) United States Patent
Matsuoka

(10) Patent No.: US 6,786,742 B2
(45) Date of Patent: Sep. 7, 2004

(54) SHIELD CABLE CONNECTOR WITH LATCH LOCK SYSTEM

(75) Inventor: Hiroyuki Matsuoka, Kanagawa (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/239,482

(22) PCT Filed: Apr. 12, 2001

(86) PCT No.: PCT/US01/12238

§ 371 (c)(1),
(2), (4) Date: Dec. 9, 2002

(87) PCT Pub. No.: WO01/89043

PCT Pub. Date: Nov. 22, 2001

(65) Prior Publication Data

US 2004/0002263 A1 Jan. 1, 2004

(51) Int. Cl.[7] ..... H01R 4/66
(52) U.S. Cl. ..... 439/95; 439/607; 439/939
(58) Field of Search ..... 439/108, 607–610, 439/45, 939

(56) References Cited

U.S. PATENT DOCUMENTS 5,112,251 A * 5/1992 Cesar ..... 439/607
5,387,130 A 2/1995 Fedder et al.
6,005,186 A 12/1999 Bachman

FOREIGN PATENT DOCUMENTS

| | | |
|---|---|---|
| JP | 7-320816 | 12/1995 |
| JP | 10-189150 | 4/1998 |
| WO | WO 96/08856 | 3/1999 |

* cited by examiner

*Primary Examiner*—Ross Gushi
(74) *Attorney, Agent, or Firm*—Yen Tong Florczak

(57) ABSTRACT

A cable connector allows the electrical contacts thereof to come into elastic contact with a ground plate when the cable connector connecting with a shielded cable is fit-connected to a PCB connector through the ground plate. The contact effectiveness of the electrical contacts is improved so that a shield-ground path from the shielded cable to the ground plate has a low impedance. The connector is provided with electrical contacts which are composed of generally U-like bent spring plates. Each spring plate is supported at one end thereof on the shield shell, and comes into elastic contact with the ground plate when the cable connector is fitted into the mating connector.

12 Claims, 9 Drawing Sheets

SHIELD CABLE CONNECTOR WITH LATCH LOCK SYSTEM

BACKGROUND OF THE INVENTION

The present invention relates to a cable connector which electrically connects with an electromagnetic wave shielded cable generally for use in various electronic equipment including communication equipment such as an electronic automatic exchange, an electronic transmission equipment or the like and computer equipment. In detail, the present invention relates to a cable connector which has a ground plate between the cable connector and a mating connector to form a shield-ground path from the cable to the ground plate so as to drop external electromagnetic wave noise mixed in from the electromagnetic wave shielded cable. In more detail, the present invention relates to a cable connector forming a shield-ground path by bringing conductive electrical contacts provided on the cable connector into elastic contact with the ground plate when the connector is fit-connected. The present invention also relates to a connector system including the cable connector and communication equipment using the connector system.

An electronic automatic exchange houses, for example, a plurality of exchange units in its cabinet. The exchange unit is provided with a printed circuit board having a printed circuit board (PCB) connector in its casing. The casing of the exchange unit is conductive and this conductive casing electromagnetically shields the printed circuit board. Part of the conductive casing is used as a ground plate by grounding this part. A cable connector electrically connected to the electromagnetic wave shielded cable is used to electrically connect PCB connectors in the same electronic automatic exchange to each other or PCB connectors in separate electronic automatic exchanges to each other.

FIG. 1 shows how a cable connector 111 connected to a shielded cable 119 is fit-connected to a PCB connector 103 via a ground plate 101 of an exchange unit. The PCB connector 103 is constituted by an insulator 107 holding male contacts 105 placed in its inner space. On the other hand, the cable connector 111 is provided with female contacts 115 which electrically connect to signal lines 121 of the cable 119 and the respective male contacts 105 of the PCB connector 103, a contact housing 117 for housing the female contacts 115, a shield shell having conductivity (not shown), an insulating cover 118 for enclosing the shield shell and electrical contacts 113 which extend from the shield shell and are exposed from a gap between the contact housing 117 and the insulating cover 118.

The cable 119 is constituted such that a plurality of signal lines 121 are enclosed with a jacket shield. These signal lines 121 are electrically connected to the respective female contacts 115 while the jacket shield is electrically connected to the shield shell of the cable connector 111. When the connector is fit-connected, a shield-ground path is formed from the cable 119 to the ground plate 101 since electrical connection is secured by bringing the electrical contact 113 into elastic contact with the conductive ground plate 101.

However, the electrical contacts 113 shown in FIG. 1 are of a cantilever type, in which a plate spring is straight. Since the spring length from a supported end (fulcrum of the spring) held by the shield shell to a contact end, which is an action point, is short in the electrical contact 113 having a straight plate spring, the spring generates greater displacement in relation to a load (so called rigid spring having a large spring constant value). As a result, a spring displacement region required for obtaining a sufficient contact force inevitably becomes small. When a distance between the electrical contact 113 and the ground plate 101 is increased due to poor location accuracy of the ground plate 101 in relation to the cable connector 111, variation in protrusion levels of the contact ends of the electrical contacts 113 and so forth, the contact of the electrical contacts 113 to the ground plate 101 is deteriorated (sufficient spring force cannot be secured). Therefore, a problem arises that impedance of the shield-ground path is increased, thereby resulting in decline of the shield ground effect.

SUMMARY OF THE INVENTION

Accordingly, an object of the present invention is to provide a cable connector in which a shield-ground path from a shielded cable to a ground plate has low impedance when a cable connector connected to the shielded cable is fit-connected to a mating connector via the ground plate. Another object of the present invention is to provide a connector system including this cable connector and communication equipment using this connector system.

To achieve the above objects, the present invention provides a cable connector which electrically connects to a shielded cable containing signal lines shielded with a jacket shield and is fit-connected to a mating connector via a ground plate. This cable connector is provided with a contact housing including first contacts electrically connected to signal lines, a shield shell which electrically connects to the jacket shield and covers the contact housing and an insulating cover for covering the shield shell. The cable connector has electrical contacts which are composed of generally U-like bent plate springs supported at one ends on the shield shell and come into elastic contact with the ground plate when the cable connector is fit into a mating connector.

The cable connector having the above constitution, on a surface opposed to the mating connector, has electrical contacts which are composed of generally U-like bent plate springs supported at one ends on the shield shell and come into elastic contact with the ground plate when the cable connector is fit into the mating connector. That is, the bent plate spring typically has a generally U-like shape, but those bent into a generally V-like shape, a generally W-like shape, a generally bellows-like shape and the like are also encompassed. An end portion on the cable side of the generally U-like bent plate spring is fixed and supported on the shield shell.

In case of a generally U-like bent plate spring, when one U-like end on the cable side (first supported end) is fixed and supported on the shield shell, the end fixed and supported on the shield shell becomes a fulcrum of the spring while the U-like bent site becomes an action point of the spring. Furthermore, this bent site also becomes a fulcrum for the other end having a U-like shape (end portion on the mating connector side). The other end on the mating connector side becomes a final action point. In a generally U-Like bent plate spring, one end on the cable side becomes a fulcrum of a spring and the other end on the mating connector side becomes the final action point. The whole length of the generally U-like plate spring serves as the spring length. Thus, since the length of a bent type spring can be made longer spring than a straight spring, the spring constant of the plate spring can be reduced as compared with that of a conventional straight spring. As a result, a large spring displacement region required for obtaining a necessary and sufficient contact force can be secured. Therefore, since stable contact (force) can be obtained between the plate springs and the ground plate, electrical connectability of the electrical contacts to the ground plate is improved and the shield-ground path from the shielded cable to the ground plate has low impedance.

The electrical contact preferably extends from an end portion of the bent plate spring on the cable side in a fitting direction of the connector on the cable side and has a supported portion held by the shield shell. According to such a constitution, the end portion of the bent plate spring on the cable side is fixed and supported at the supported portion held by the shield shell. Since the supported portion can resist the elastic force acted when the bent plate spring comes into contact with the ground plate, supporting property of the electrical contact is improved and thereby stable contact can be obtained. Therefore, electrical connectability of the electrical contacts to the ground plate is improved.

The supported portion of the electrical contact can also be constituted so as to be held at its part by the shield shell. In the supported portion of this constitution, the end portion on the bent plate spring side of the part held by the shield shell serves as a fulcrum of the spring and the part not held by the shield shell becomes a spring action part That is, in addition to the bent plate spring, the part not held by the shield shell acts as a spring. Therefore, the spring length of the electrical contact is made further longer than when substantially whole the supported portion is held by the shield shell. Therefore, since the spring constant of the plate spring can be reduced, further stable contact with the ground plate can be obtained on the basis of the aforementioned theory. Thus, electrical connectability of the electrical contacts to the ground plate is further improved.

The electrical contacts are preferably used as at least one pair. According to such a constitution, even if there is a displacement in a connector fitting direction between the electrical contacts and the ground plate, either of the electrical contacts absorbs the displacement. Therefore, stable contact can be obtained. Thus, electrical connectability of the electrical contacts to the ground plate is improved.

Preferably, the electrical contacts are formed integrally with the shield shell. A portion to be processed which has a shape corresponding to the electrical contact is provided on the shield shell in advance. The portion to be processed is subjected to processing such as folding or the like to form an electrical contact in a predetermined shape. Therefore, as compared with the case where separately formed electrical contacts are attached to the shield shell afterwards, the number of components and the number of manufacturing processes are reduced, thereby resulting in reduced costs.

In a connector system in which a ground plate is arranged between the cable connector and the mating connector, a shield-ground path is formed therebetween when the cable connector is fit-connected to the mating connector since the electrical contacts of the cable connector come into elastic contact with the ground plate. In this connector system, the electrical contacts come into stable contact with the ground plate by a necessary and sufficient spring force with the same reason as described above about the cable connector. Therefore, a shield-ground path having low impedance can be formed and external electromagnetic wave noise can be reduced.

The PCB connector as the mating connector and the cable connector are applied in communication equipment provided with a plurality of units having printed circuit boards in a box-like conductive casing. That is, in this communication equipment, part of the conductive casing for the units is grounded and used as a ground plate. A constitution is obtained that the ground plate is arranged between the PCB connector provided on the printed circuit board and the cable connector having the electrical contacts. In the communication equipment having such a constitution, when the cable connector is fit-connected to the PCB connector, the electrical contacts come into stable contact with the ground plate with the same reason as described above about the connector system. Therefore, the printed circuit boards housed in respective units can be connected by a shield-ground path having low impedance and external electromagnetic wave noise mixed in can be reduced.

DETAILED DESCRIPTION OF THE PREFERRED EMBODIMENTS

A cable connector 10, a connector system 80 including the cable connector 10 and an electronic automatic exchange using the connector system 80 according to one embodiment of the present invention are described in detail below with reference to FIGS. 2–9.

Figure 1:
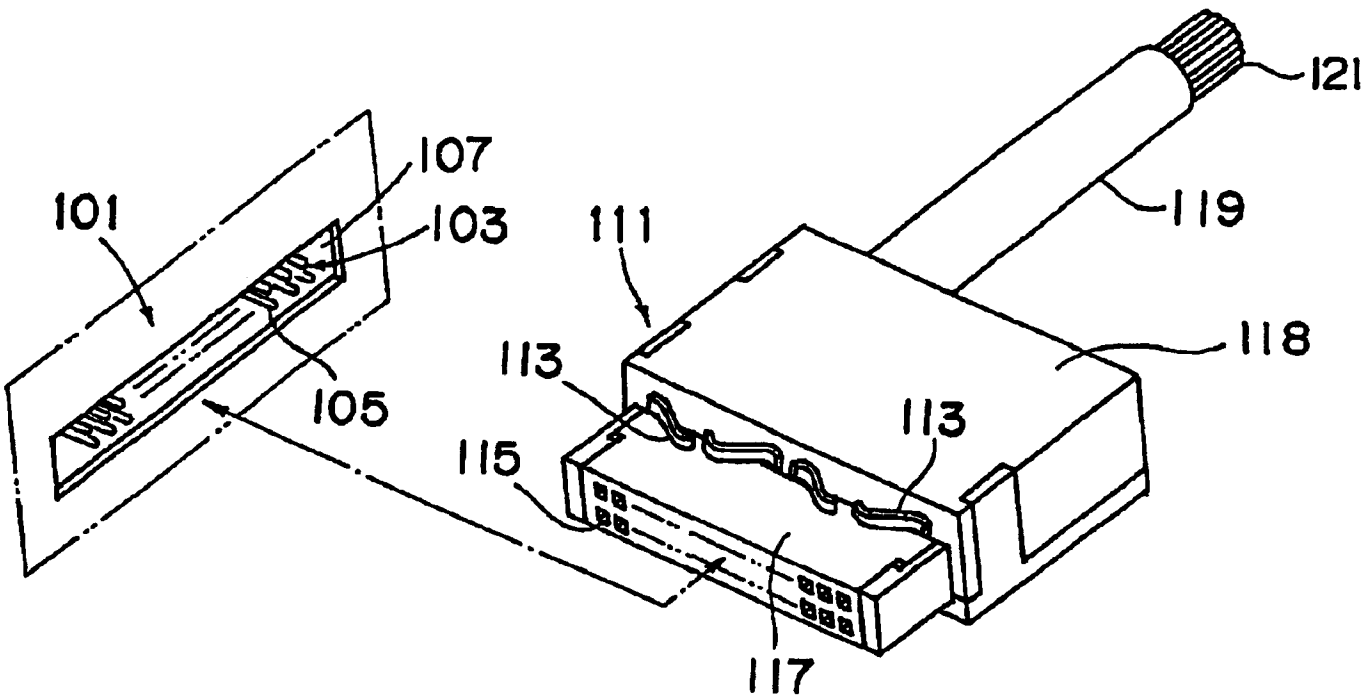
FIG. 1 is a perspective view showing a conventional PCB connector and cable connector.
Figure 2:
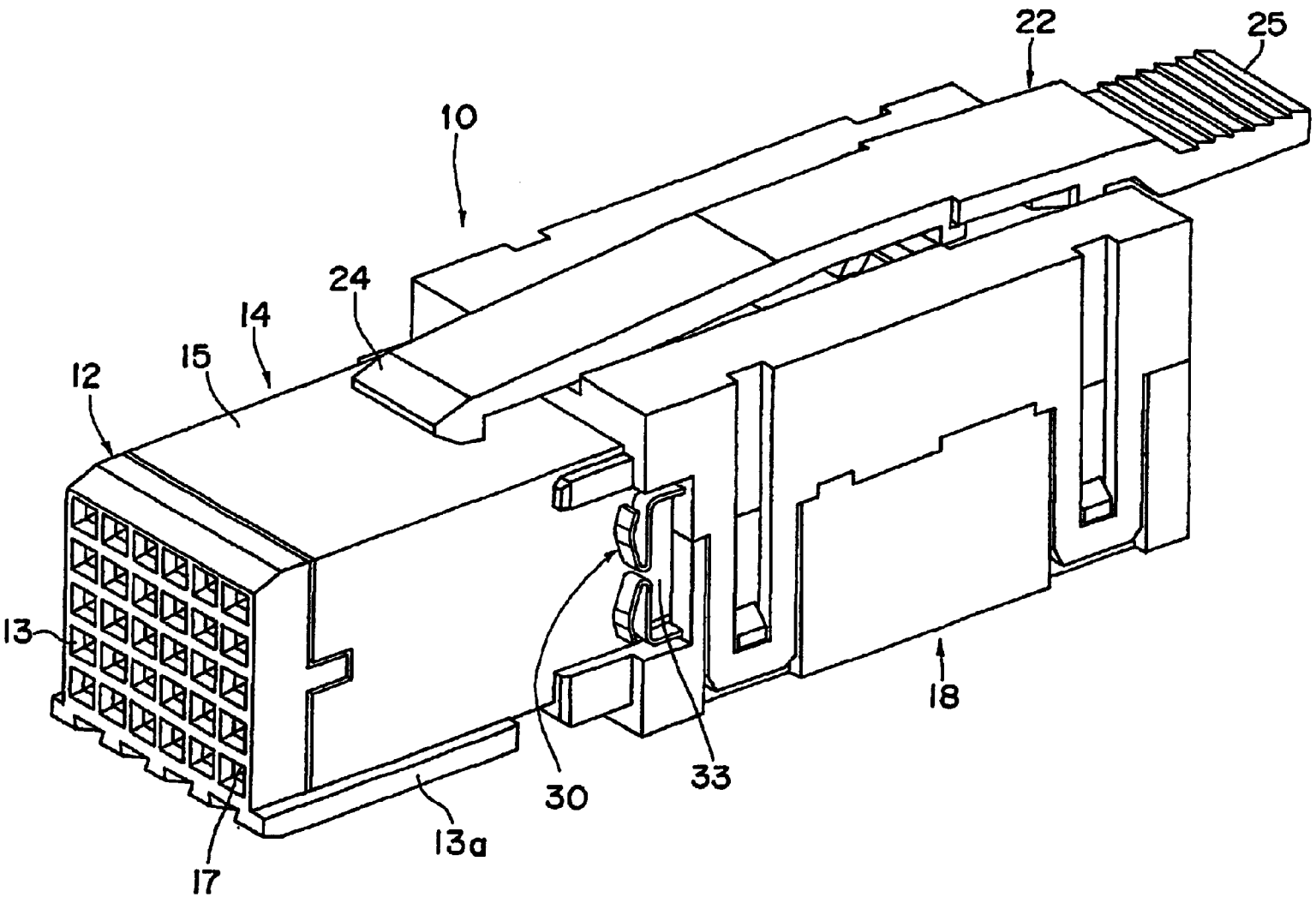
FIG. 2 is a perspective view showing a cable connector of the present invention.
Figure 3:
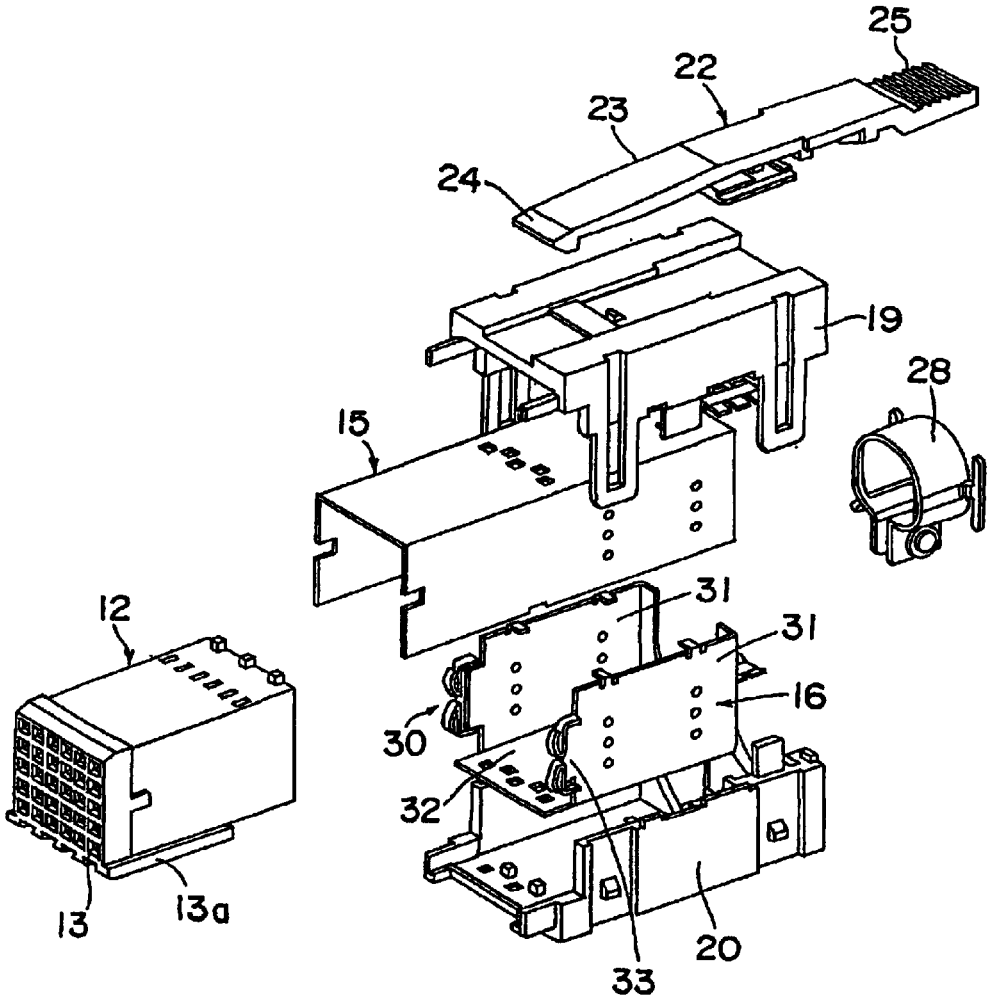
FIG. 3 is an exploded perspective view of the cable connector shown in FIG. 2.
Figure 4:
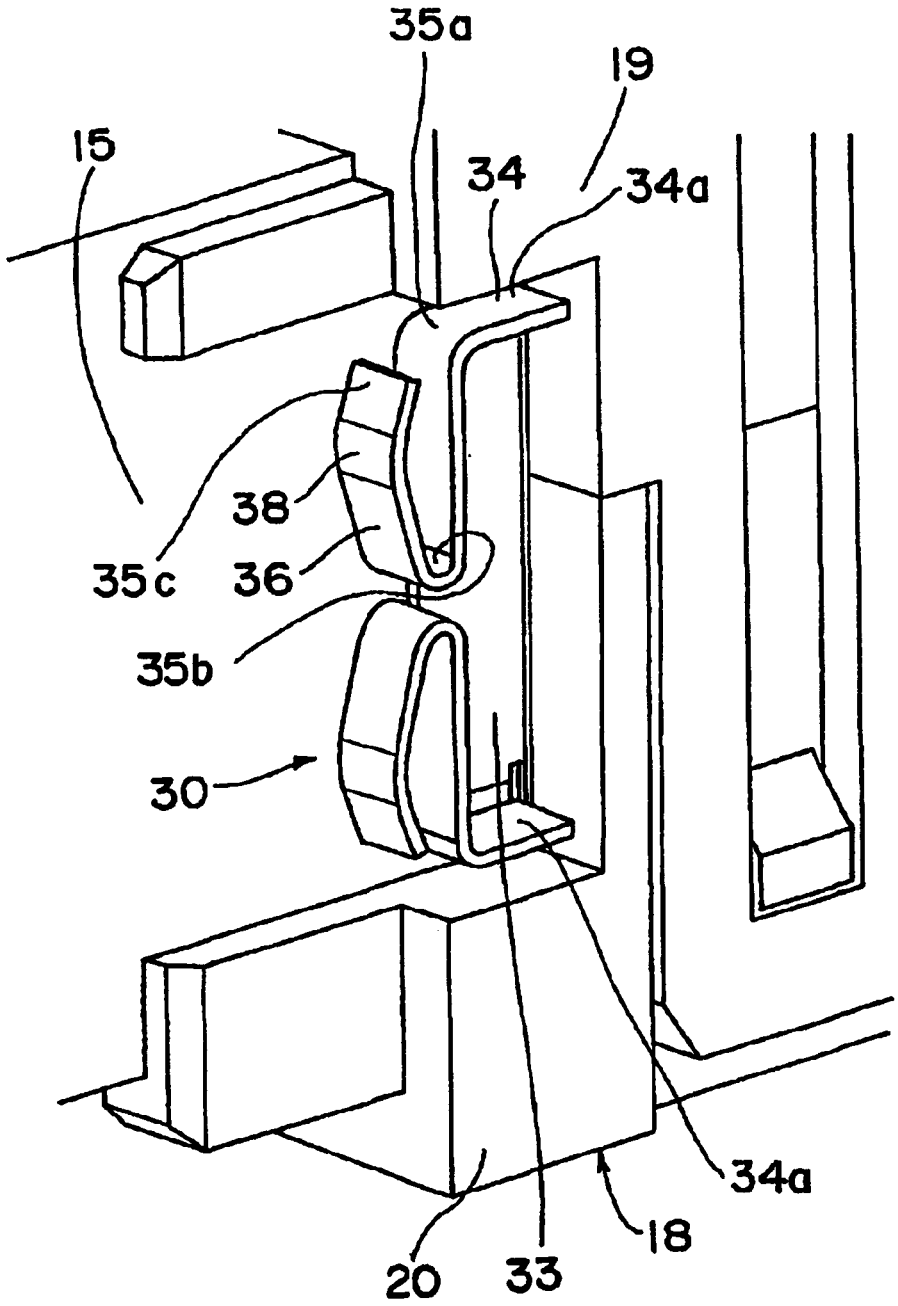
FIG. 4 is a enlarged view showing a portion in the vicinity of electrical contacts in the cable connector shown in FIG. 2.

FIG. 2 is a perspective view showing a cable connector 10 connected to a shielded cable (not shown). FIG. 3 is an exploded perspective view of the cable connector 10 shown in FIG. 2.

The cable connector 10 is provided with a contact housing 12, a cable side shield shell 14 enclosing the contact housing 12, an insulating cover 18, a latch member 22 and a cable clamp member 28.

The contact housing 12 having a square-shape is obtained by molding an insulating resin material (for example, insulating resin such as PBT, PCT, nylon or the like). The lower wall of the contact housing 12 has a first guide 13*a* provided with guide slots. The front wall of the contact housing 12 has terminal holes 13 arranged in a matrix (for example, at 2-mm pitches). A female contact (first contact) 17 is arranged in each terminal hole 13. The female contact 17 is composed of copper alloy for spring. The portion in electrical contact is preferably subjected to gold plating. The female contact 17 has a portion to be connected with a signal line at an end portion on the cable side while having a portion to be connected to a male contact 46 at an end portion on the substrate side.

The cable side shield shell 14 is composed of, for example, a conductive material such as copper alloy or the like and has a shape like a box covering the contact housing 12. The box-like cable side shield shell 14 is constituted by combining two parts, an upper shield shell 15 and a lower shield shell 16, each having a "U"-like cross section. The lower shield shell 16 is composed of a bottom wall 32 and two sidewalls 31. A cable clamp section is provided at an end portion on the cable side of the bottom wall 32. The cable clamp section is connected with a cable clamp member 28 holding an exposed jacket shield.

The lower shield shell 16 has contact mounting portions 33 extending towards the PCB connector 40 on the PCB connector side of both the sidewalls 31. Two pairs of supported portions 34 extending in a connector fitting direction perpendicular to the contact mounting portions 33, that is, four supported portions 34 in total are provided at upper and lower side end portions of the contact mounting portions 33. The supported portion 34 constitutes part of an electrical contact 30 described below and is fixed and supported on the contact mounting portion 33.

That is, the electrical contact 30 is a plate-like plate spring composed of the same conductive material as the cable side shield shell 14 such as copper alloy or the like and is provided with a generally U-like bent plate spring 36 and a supported portion 34 which extends from the cable side end portion of the bent plate spring 36 and is supported on the contact mounting portion 33 of the lower shield shell 16. This electrical contact 30 has a so-called "L-U superimposed" shape, in which a "U"-like right-hand side piece is superimposed on an "L"-like bottom piece. In the cable connector 10, two pairs of electrical contacts 30, that is, four electrical contacts 30 in total are provided on the contact mounting portion 33.

In the U-like bent plate spring 36 bent at a second supported end 35*b*, one end (first supported end) 35*a* on the cable side is fixed and supported on the contact mounting portion 33 of the lower shield shell 16 via the supported portion 34. An end portion (distal action end) 35*c* on the PCB connector side is displaced freely in a connector fitting direction. At this time, this end (first supported end) 35*a* on the cable side becomes a fulcrum of a spring while the U-like bent site (second supported end) 35*b* becomes an action point of the spring. The bent site 35*b* acts as a fulcrum for the end portion (distal action end) 35*c* on the PCB connector side. The distal action end 35*c* acts as a final action point.

Therefore, in the electrical contact 30 having an "L-U superimposed" shape, one end (first supported end) 35*a* on the cable side of the bent plate spring 36 becomes the fulcrum of the spring while the end portion (distal action end) 35*c* on the PCB connector side of the bent plate spring 36 becomes the final action point. In the bent plate spring 36 having an "L-U superimposed" shape, the length of the bent plate spring 36 serves as the spring length. Therefore, since the spring length is longer in the U-like bent plate spring 36, its spring constant can be reduced. As a result, a large spring displacement region where a necessary and sufficient (predetermined) contact force can be secured can be obtained. Consequently, even if the distance from the ground plate 60 is deflected, the deflection is absorbed and stable contact allowing a substantially predetermined spring force to be secured can be secured.

This electrical contact 30 can be fabricated by various methods. For example, the following method can be employed. That is, two plate-like thin strips extending towards the PCB connector side in a predetermined length are formed at side end portions of the contact mounting portion 33 in advance. Both the plate-like thin strips are bent about 90 degrees towards the center line of the contact mounting portion 33. Then, both the plate-like thin strips are bent about 90 degrees so that free ends 35*c* thereof protruded from the contact mounting portion 33 are opposed to each other and the first supported ends 35*a* are formed. Then, the plate-like thin strips are bent into a generally U-like shape so that the free ends 35*c* of thereof face the PCB connector side and the second supported ends 35*b* are formed. Thus, the U-like bent plate springs 36 are formed.

In the electrical contact 30, the bent plate spring 36 is constituted integrally with the supported portion 34. In addition to this, when the electrical contact 30 is further constituted integrally with the contact mounting portion 33, the number of components and the number of manufacturing processes can be reduced, thereby resulting in reduced costs. The electrical contact 30 can be constituted as a member separate from the lower shield shell 16. For example, an electrical contact 30 of an "L-U superimposed" shape is separately formed in advance. Then, this electrical contact 30 is fixed to the side end of the contact mounting portion 33 by various known methods such as screwing, welding or the like.

A generally planar contact portion 38 is formed by slightly bending the PCB connector side surface of the bent plate spring 36 at two sites in the vicinity of the free end 35*c* towards the cable side. Contact effectiveness with the contact plate 60 can be improved by providing the generally planar contact portion 38.

The insulating cover 18 for covering the cable side shield shell 14 has a box-like shape and is obtained by combining two parts, an upper insulating cover 19 and a lower insulating cover 20, each having a "U"-like cross section. A recessed portion is formed in the upper surface of the upper insulating cover 19. A latch member 22 is housed in the recessed portion and pivotally fixed by an axle provided in the recessed portion.

The latch member 22 has a latch 24 in a front region of an arm 23 extending in a fit-connecting direction and an operating section 25 in a rear region of the arm 23. The latch 24 projecting downward is engaged with a locking hole 47 of the PCB connector 40 described below.

Figure 5A:
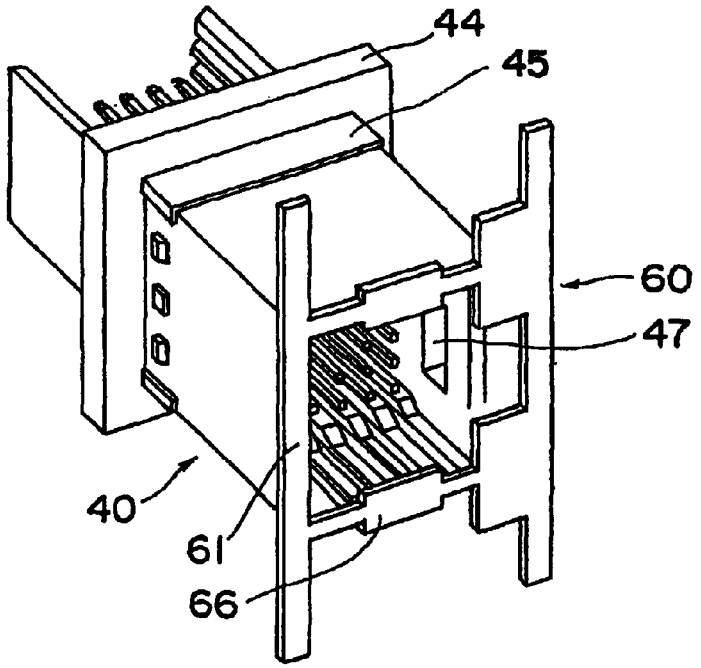
FIG. 5 is perspective views showing a PCB connector and a ground plate arranged in front of the PCB connector and 5A and 5B show an assembled state and a disassembled state, respectively.
Figure 5B:
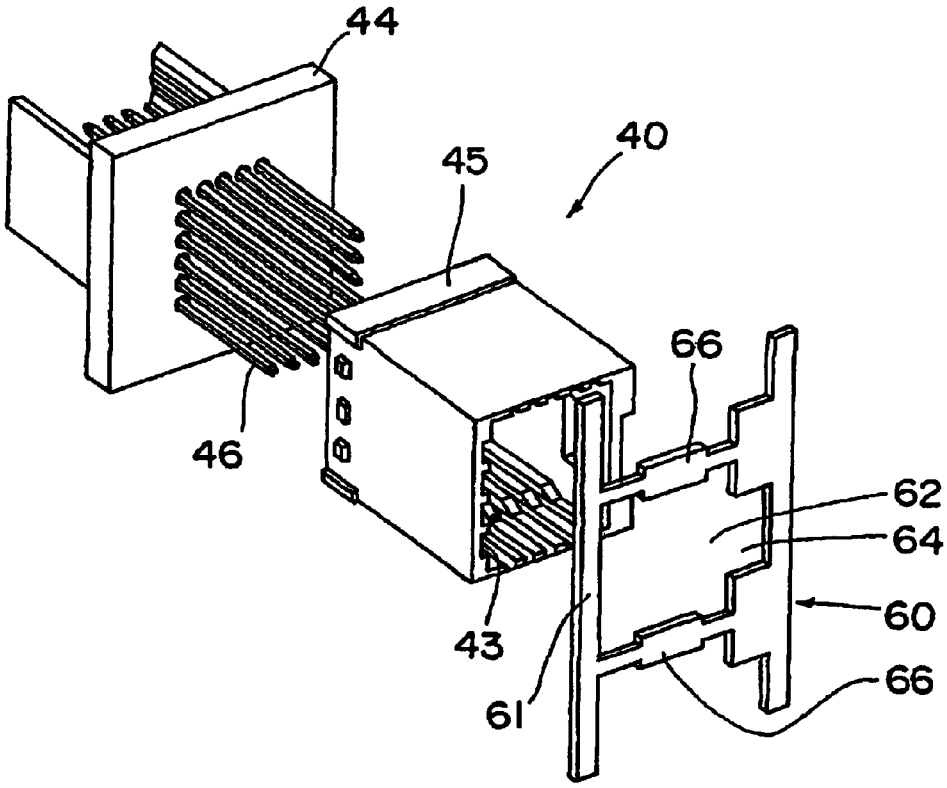

The PCB connector 40 mating with the cable connector 10 is described below with reference to FIG. 5. FIG. 5 is perspective views showing the PCB connector 40 and a ground plate 60 arranged in front of the PCB connector 40.

The PCB connector 40 is provided with a box-like substrate housing 45 and a substrate side shield shell arranged inside the substrate housing 45.

The substrate housing 45 is composed of an insulating resin material as in the case of the contact housing 12 and has a shape like a box provided with space for receiving the contact housing 12. A locking hole 47 for engaging with the latch 24 of the latch member 22 is provided on the upper wall surface of the substrate housing 45. Guide slots 43 corresponding to the first guide 13*a* of the contact housing 12 are provided in the inner surface of the lower wall of the substrate housing 45. A locking portion (not shown) for mounting the housing to a printed circuit board 44 is provided in the substrate sidewall surface of the substrate housing 45.

The substrate side shield shell is composed of the same conductive material as the cable side shield shell 14 such as copper alloy or the like and has a generally box-like shape.

A known printed circuit board 44 composed of PCB or the like is provided with through holes arranged in a matrix (for example, at 2-mm pitches). Conductive male contacts (second contacts) 46 are press fitted into these through holes so as to be fixed to the printed circuit board 44. Then, both end portions of the male contacts 46 fixed to the printed circuit board 44 are projected towards the circuit side and the PCB connector 40 side, respectively. After positioned at a predetermined position of the surface on the cable connector 10 side, the PCB connector 40 is engaged to the printed circuit board 44 by using the locking portion of the substrate housing 45 so as to be integrated with the printed circuit board 44. The printed circuit board 44 is usually provided with a plurality of PCB connectors 40.

Described below with reference to FIGS. 6–9 is the case where respective PCB connectors 40 of the printed circuit board 44 are electrically connected in a shield ground state by applying a connector system 80 composed of the cable connector 10, PCB connector 40 and ground plate 60 in a electronic automatic exchange 90 housing an exchange unit including the printed circuit board 44.

Figure 6A:
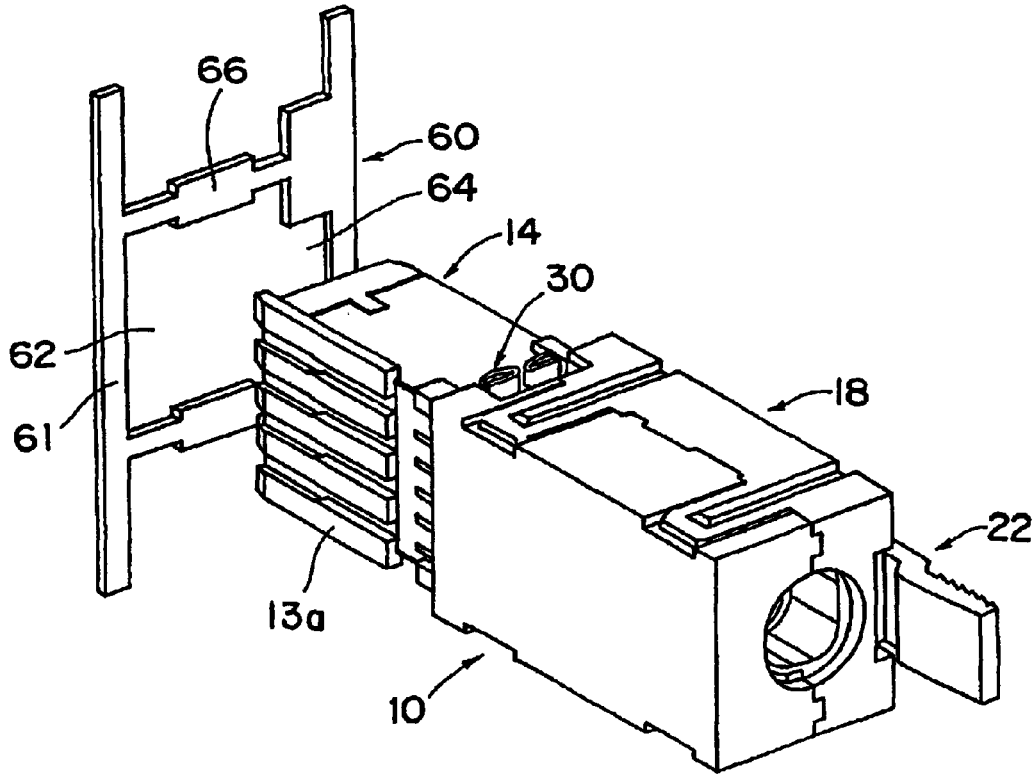
FIGS. 6A and 6B are perspective views showing states before and after the electrical contacts of the cable connector come into contact with the ground plate, respectively.
Figure 6B:
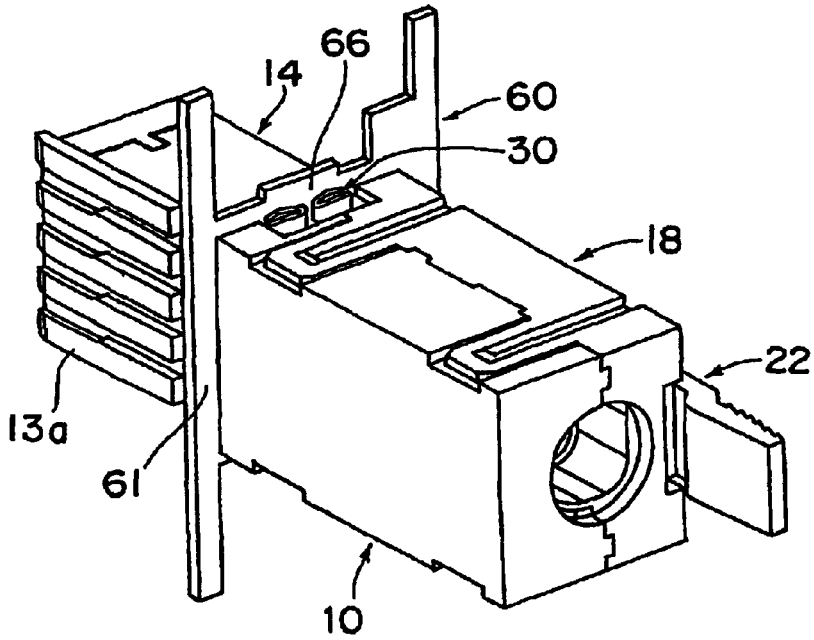
Figure 7:
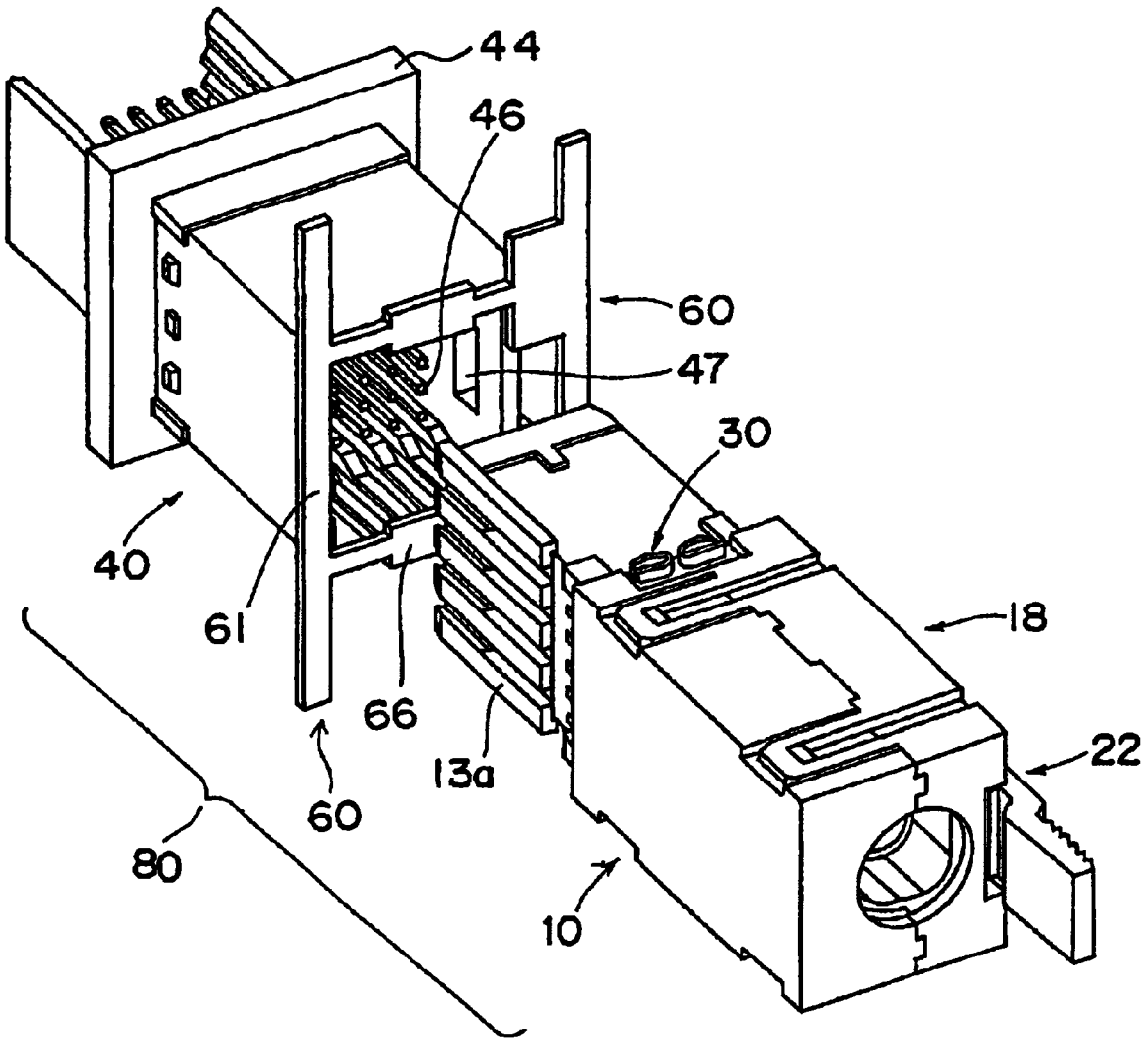
FIG. 7 is a perspective view showing a connector system wherein a cable connector is fit-connected to a PCB connector provided on a printed circuit board via the ground plate.
Figure 8:
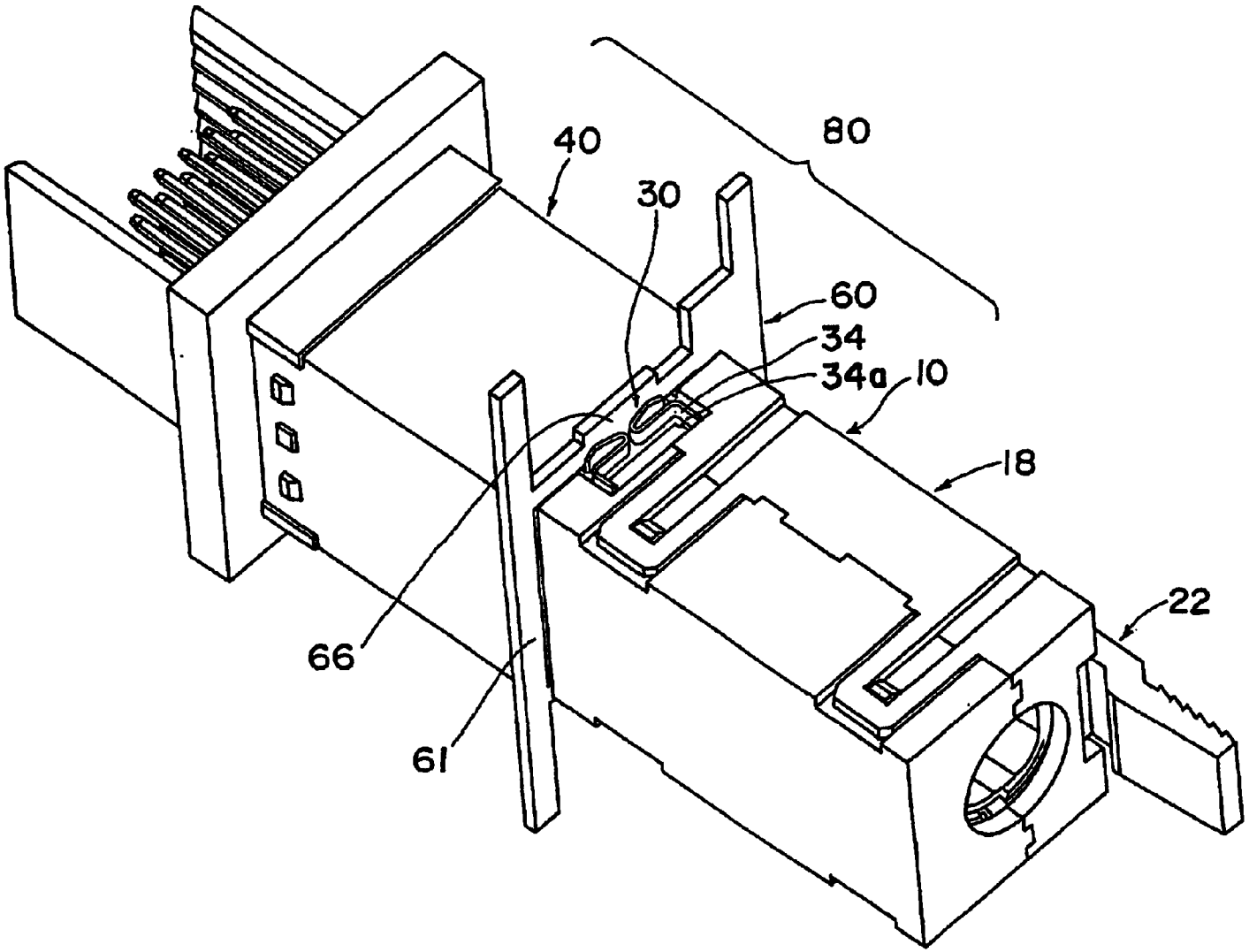
FIG. 8 is a perspective view showing how the electrical contacts come into contact with the ground plate when the cable connector is fit-connected with the connector system shown in FIG. 7.
Figure 9:
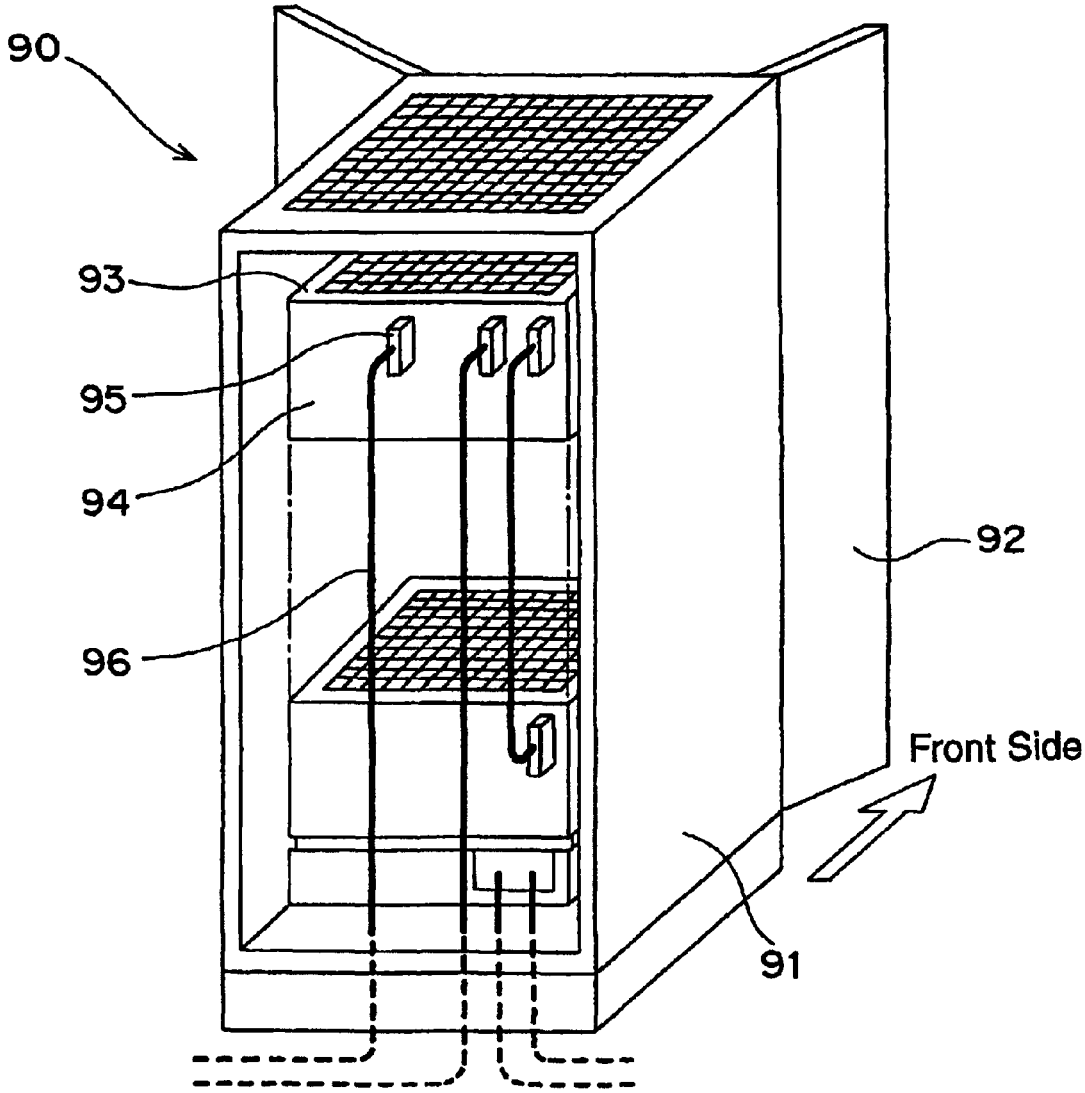
FIG. 9 is a perspective view showing an electronic automatic exchange using the connector system shown in FIG. 8.

FIG. 6 is perspective views showing states before and after the electrical contacts 30 of the cable connector 10 come into contact with the ground plate 60 of the PCB connector 40 (not shown). FIG. 7 is a perspective view showing a connector system 80 in which the cable connector 10 is fit-connected with the PCB connector 40 provided on the printed circuit board 44 via the ground plate 60. FIG. 8 is a perspective view showing how the electrical contacts 30 come into contact with ground plate 60 in the connector system 80 shown in FIG. 7 when the connectors are fit-connected. FIG. 9 is a perspective view showing an electronic automatic exchange using the connector system 80 shown in FIG. 8.

As shown in FIG. 9, the electronic automatic exchange 90 is provided with a plurality of box-like exchange units 93 in a conductive cabinet 91. The cabinet 91 has a front door 92 which can be opened and closed in front and is constituted such that a rear panel on the rear surface can be removed. Each exchange unit 93 includes at least one printed circuit board. The exchange unit 93 is constituted by a conductive casing and shields the printed circuit board housed therein. Part of the conductive casing, for example, a back plate 94 is grounded as a ground plate 60. Each printed circuit board mounted inside the conductive casing is provided with at least one PCB connector described above. Each PCB connector is fit-connected with a cable connector 95 connected to a shielded cable 96. The cable connector 95 connected to the shielded cable 96 electrically connects the exchange units 93 in this electronic automatic exchange 90 to each other or units in communication equipment such as other electronic automatic exchanges or the like to each other.

The shielded cable 96 shown in FIG. 9 has a plurality of signal lines, a conductive jacket shield enclosing and shielding these signal lines and an insulating coating for coating the outer periphery of the jacket shield. The jacket shield exposed by removing the insulating coating at a cable end portion is tightly bound to a conductive cable clamp member 28 to be electrically connected. The cable clamp member 28 is electrically connected and fixed to the cable clamp section of the lower shield shell 16 of the cable connector 10. Then, respective signal lines are electrically connected and fixed to the female contacts 17 of the cable connector 10. Therefore, when the shielded cable 96 is connected to the cable connector 10, both a shielded path and a signal transmission path are formed therebetween.

As shown in FIG. 6, the ground plate 60 has an aperture provided at a position corresponding to each PCB connector 40 which has a size enough to insert and extract the cable connector 10. This aperture is provided with an aperture 62 for housing for inserting the contact housing 12 and an aperture 64 for a latch member for inserting the latch member 22. In addition to a portion corresponding to one connector system, the ground plate 60 is shown with the lower half portion and upper half portion corresponding to connector systems arranged thereabove and therebelow, respectively, in FIGS. 6–8. That is, the ground plate 60 used by one connector system is a portion enclosed by a generally square-shaped frame 61. The contact portions 66 provided on the upper and lower frame in the figure are used for contact with electrical contacts 30. The ground plate 60 is mounted to the exchange unit 93 in FIG. 9 in a state that space for receiving the PCB connector 40 is visible from the aperture of the ground plate 60.

The connector system 80 is constituted by the cable connector 10 electrically connected to the shielded cable 96, the PCB connector 40 electrically connected to the printed circuit board and the ground plate 60 of the exchange unit 93.

Described in detail blow is formation of the shield-ground path between exchange units 93 of electronic automatic exchange 90 when the cable connector 10 is fit-connected to the PCB connector 40 by applying the connector system 80 to the electronic automatic exchange 90.

There are prepared the PCB connector 40 whose receiving space is visible from the aperture of the contact plate 60 and cable connector 10 electrically connected to the shielded cable 96. The cable connector 10 is positioned so that the contact housing 12 of the cable connector 10 matches the aperture shape of the contact plate 60 and the receiving space of the PCB connector 40. When the contact housing 12 is inserted into the receiving space of the PCB connector 40, the first guide 13*a* of the cable connector 10 is guided along the guide slots 43 of the PCB connector 40 and the cable connector 10 is fit-connected to the PCB connector 40.

When the connector is fit-connected, the latch 24 of the latch member 22 is engaged to the locking hole 47 of the PCB connector 40. The male contacts 46 of the PCB connector 40 are fit into the female contacts 17 of the cable connector 10. The electrical contacts 30 of the cable connector 10 come into contact with the contact portion 66 of the ground plate 60 with a sufficient spring force. Since the bent plate spring 36 can reduce the spring constant of the plate spring, a large spring displacement region which allows a predetermined contact force to be secured can be obtained and thereby a necessary and sufficient spring force between the spring and the ground plate 60 can be secured. Therefore, a signal transmission path is formed while the shield-ground path with low impedance passing through the jacket shield of the shielded cable 96, the cable side shield shell 14, the electrical contact 30 and the ground plate 94 can be established. As a result, since external electromagnetic wave noise mixed in from the shielded cable 96 is dropped to the ground by the shield-ground path, a sufficient shielding effect can be obtained.

The cable side shield shell 14 of the cable connector 10 and the substrate side shield shell of the PCB connector 40 are provided with a first contact portion and a second contact portion, respectively, which are not shown in the figure. When the cable connector 10 is fit-connected to the PCB connector 40 via the ground plate 60, the first contact portion comes into electrical contact with the second contact portion and a conducting path is formed between the cable side shield shell 14 and the substrate side shield shell. Therefore, the shield-ground path passing through the substrate side shield shell, the cable side shield shell 14, the electrical contact 30 and the ground plate 60 can also be established on the PCB connector 40 side.

The U-like bent plate spring 36 can obtain a similar effect even when the plate spring is bent in a V-like shape, W-like shape, bellows-like shape or the like.

A slit or the like can also be provided between the supported portion 34 of the electrical contact 30 and the contact mounting portion 33 of the lower shield shell 16 so that part of the supported portion 34 is supported on the contact mounting portion 33.

In the supported portion 34 of the above constitution, a portion on the cable side, that is, a proximal end supported portion 34*a* is supported on the contact mounting portion 33 of the lower shield shell 16 and a portion on the PCB connector side is not supported on the contact mounting portion 33 of the lower shield shell 16. Therefore, the proximal end supported portion 34*a* becomes a fulcrum of the spring while an end portion (first supported end) 35*a* of the supported portion 34 on the PCB connector side becomes an action point of the spring.

Therefore, in the electrical contact 30 having an "L-U superimposed" shape, the proximal end supported portion 34*a* of the supported portion 34 becomes the fulcrum of the spring while the end portion (distal action end) 35*c* of the U-like bent plate spring 36 on the PCB connector side becomes the final action point. In the plate spring 36 having an "L-U superimposed" shape, the length of the portion not supported on the contact mounting portion 33 of the lower shield shell 16 (bent plate spring 36+unsupported portion of the supported portion 34) serves as the spring length. Therefore, the spring length of the electrical contact 30 becomes even longer than when generally whole the supported portion 34 is supported on the contact mounting portion 33. Since the spring constant of the electrical contact 30 can be reduced, a large spring displacement region allowing a predetermined contact force to be secured can be obtained and thereby a necessary and sufficient spring force between the spring and the ground plate 60 can be secured. Therefore, electrical connectability to the ground plate 60 of the electrical contact 30 is improved.

DESCRIPTION OF REFERENCE NUMERALS

10: Cable connector
12: Contact housing
13: Contact hole
13*a*: First guide
14: Cable side shield shell
15: Upper shield shell
16: Lower shield shell
17: Female contact (first contact)
18: Insulating cover
19: Upper insulating cover
20: Lower insulating cover
22: Latch member
23: Arm
24: Latch
25: Operating section
28: Cable clamp member
30: Electrical contact
31: Sidewall
32: Bottom wall
33: Contact mounting portion
34: Supported portion
34*a*: Proximal end supported portion
35*a*: Cable side end portion (first supported end)
35*b*: U-like bent site (second supported end)
35*c*: End portion on PCB connector side (distal action end)
36: Bent plate spring
38: Planar contact portion
40: Printed circuit board (PCB) connector (mating connector)
43: Guide slot
44: Printed circuit board (PCB)
45: Substrate housing
46: Male connector (second contact)
47: Locking hole
60: Ground plate
61: Frame
62: Aperture for housing
64: Aperture for latch member
66: Contacting portion
80: Connector system
90: Electronic automatic exchange
91: Cabinet
92: Front door
93: Exchange unit
94: Back plate (ground plate)
95: Cable connector
96: Shielded cable

What is claimed is:

1. A cable connector (10) which electrically connects with a shielded cable (96) composed of signal lines shielded by a jacket and also fit-connects along an insertion direction with a mating connector (40) through a ground plate (60), said cable connector (10) comprising a contact housing (12) including a first contact (17) which electrically connects with the signal lines, a shield shell (14) which electrically connects with the jacket shield and covers the contact housing (12), and an insulating cover (18) which covers the shield shell (14), characterized in that there are provided electrical contacts (30) composed of generally U-like bent plate springs (36) which are each supported at one end (35*a*) on the shield shell (14), and which lie generally parallel to the plane of the shield shell (14) on which the springs (36) are supported, and which come into elastic contact with the ground plate (60) when the cable connector (10) is fitted into the mating connector (40), wherein the springs (36) are positioned on shield shell (14) to compress in a direction generally parallel with the insertion direction.

2. A cable connector according to claim 1, wherein said electrical contact (30) extends from the one end (35*a*) along the insertion direction of the connector on the side of the cable and has a supported portion (34) held by the shield shell (14).

3. A cable connector according to claim 2, wherein said supported portion (34) is supported at its proximal end portion (34*a*) by the shield shell (14).

4. A cable connector according to claim 1, further comprising a pair of said electrical contacts (30).

5. A connector system (80) comprising a cable connector (10) according to claim 1, a mating connector (40) for receiving the cable connector (10) in the insertion direction, and a ground plate (60) arranged between the cable connector (10) and the mating connector (40), characterized in that the electrical contacts (30) of the cable connector (10) come into elastic contact with the ground plate (60) and compress springs (36) in a direction generally parallel with the insertion direction when the cable connector (10) is fit-connected to the mating connector (40).

6. The connector system according to claim 5, wherein said electrical contact (30) extends from the one end **(35*a*) along the insertion direction of the connector on the side of the cable and has a supported portion (34) held by the shield shell (14)**.

7. The connector system according to claim 6, wherein said supported portion (34) is supported at its proximal end portion **(34*a*) by the shield shell (14)**.

8. The connector system according to claim 5, further comprising a pair of said electrical contacts (30).

9. Communication equipment comprising a unit (93) which includes a substrate (44) provided with a printed circuit board (PCB) connector (40) in a casing, said unit (93) comprising a connector system (80) according to claim 1, characterized in that the electrical contacts (30) of said cable connector (10) come into elastic contact with the ground plate (60) of the unit casing and compress springs (36) in a direction generally parallel with the insertion direction when the cable connector (10) is fit-connected to the printed circuit board connector (40).

10. The communication equipment according to claim 9, wherein said electrical contact (30) extends from the one end **(35*a*) along the insertion direction of the connector on the side of the cable and has a supported portion (34) held by the shield shell (14)**.

11. The communication equipment according to claim 10, wherein said supported portion (34) is supported at its proximal end portion **(34*a*) by the shield shell (14)**.

12. The communication equipment according to claim 9, further a pair of said electrical contacts (30).

* * * * *

UNITED STATES PATENT AND TRADEMARK OFFICE

CERTIFICATE OF CORRECTION

PATENT NO. : 6,786,742 B2
DATED : September 7, 2004
INVENTOR(S) : Matsuoka, Hiroyuki It is certified that error appears in the above-identified patent and that said Letters Patent is hereby corrected as shown below:

Column 2,
Line 56, delete “U-Like” and insert -- U-like -- therefore.

Column 3,
Line 22, after “part” insert -- . --.

Column 12,
Line 18, after “further” insert -- comprising --.

Signed and Sealed this

Twenty-sixth Day of April, 2005

JON W. DUDAS
*Director of the United States Patent and Trademark Office*